US006705521B1

(12) United States Patent
Wu et al.

(10) Patent No.: US 6,705,521 B1
(45) Date of Patent: Mar. 16, 2004

(54) AUTOMATIC CAR TOLL COMPUTING AND CHARGING METHOD

(75) Inventors: Quen-Zong Wu, Taoyuan (TW); Ta-Wei Jain, Taoyuan (TW); Bor-Shenn Jeng, Taoyuan (TW)

(73) Assignee: Chunghwa Telecom Co., Ltd., Taoyuan (TW)

( * ) Notice: Subject to any disclaimer, the term of this patent is extended or adjusted under 35 U.S.C. 154(b) by 6 days.

(21) Appl. No.: 10/444,139

(22) Filed: May 23, 2003

(51) Int. Cl.[7] ..... G07B 15/02
(52) U.S. Cl. ..... 235/384; 379/355.06
(58) Field of Search ..... 235/384, 385, 235/383, 381, 375; 705/72; 379/355.09, 90.01, 900, 93.28, 355.06

(56) References Cited

U.S. PATENT DOCUMENTS 4,515,994 A * 5/1985 Bolle et al. ..... 455/556.1
5,127,040 A * 6/1992 D'Avello et al. ..... 455/419
5,310,999 A * 5/1994 Claus et al. ..... 235/384
6,377,993 B1 * 4/2002 Brandt et al. ..... 709/227
6,603,843 B1 * 8/2003 Hagemann ..... 379/111
2002/0006786 A1 * 1/2002 Mine ..... 455/414
2002/0188575 A1 * 12/2002 Freeny ..... 705/72
2003/0095542 A1 * 5/2003 Chang et al. ..... 370/352

FOREIGN PATENT DOCUMENTS

TW 287264 10/1996
TW 365671 8/1999

* cited by examiner

*Primary Examiner*—Thien M. Le
(74) *Attorney, Agent, or Firm*—Rabin & Berdo, P.C.

(57) ABSTRACT

An automatic car toll computing and charging method is provided. The method includes steps of employing a cellular phone to process a log in and a log out of a car toll computing; previously storing the connection between a cellular phone number and a vehicle identification number, or keying in said vehicle identification number or other car IDs sufficient to bring out said vehicle identification number in a billing center; and calling a specific number representing a log in of an automatic computing and charging through an on-vehicle cellular communication equipment and before a car enters a toll road or bridge and hanging up, and calling a specific number representing a log out of the automatic computing and charging after leaving the toll road or bridge. Consequently, the toll can be charged through calculating all cell IDs which by a cellular phone system passes theretrough during the log in and the log out.

7 Claims, 1 Drawing Sheet

AUTOMATIC CAR TOLL COMPUTING AND CHARGING METHOD

BACKGROUND OF THE INVENTION

1. Field of the Invention

The present invention relates to an automatic car toll computing and charging method, and more particularly to an automatic car toll computing and charging method which can be applied in any kind of toll road and bridge.

2. Description of the Prior Art

The conventional automatic car toll paying method is disclosed by TW Patent Nos. 287264 ("Toll payment system", reference 1) and 365671 ("Automatic car toll paying method", reference 2). In reference 1, it includes an on-vehicle communication equipment, and an electronic account coupled to the communication equipment, wherein the electronic account is part of a cash system. And, the toll payment system includes a positioning communication equipment for positioning the communication equipment, and a distant communication equipment for communicating with the on-vehicle communication equipment and exchanging a valuable account transfer message through an assured encrypted figure to practice the toll payment.

Reference 2 disclosed an automatic toll paying method for a transportation tool driving on a highway or in an area, wherein each individual transportation tool sets a communication inputting device for communicating with a center unit and with a roadside unit in a substantial toll station and at least a virtual toll station which is geographically related to the substantial station previously decided. Moreover, the communication equipment of the transportation tool includes a receiver of a GNNS system which provides a signal and a first processor thereon to read a position of the transportation tool so as to compare with a position of the virtual toll station which is already stored in a memory for detecting a car which is entering the virtual toll station. Furthermore, the communication equipment of the transportation tool informs a transaction of the toll through a digital mobile transmission network of the center unit and then the center unit will process the toll transaction of the transportation tool and transmit a received note of the toll back to the transportation tool through the communication equipment When arriving the substantial toll station, the communication equipment of the transportation tool will send the received note to the roadside unit through a communication therewith to be an evidence of the already paid toll.

References 1 & 2 described above both utilize a car positioning device for detecting and recognizing the car which arrives the toll station and then transmit a message about arrival of the car to the billing center through an on-vehicle communication equipment for charging the toll.

SUMMARY OF THE INVENTION

An object of the present invention is to provide an automatic car toll computing and charging method which employs a cellular phone to process a log in and a log out of a car toll computing and charges the car toll through calculating all cell IDs that the cellular phone passes therethrough during the log in and log out.

Another object of the present invention is to provide an automatic car toll computing and charging method which can achieve an automatic computing and charging without employing an on-vehicle positioning device to detect an arrival of a toll location so as to economize the cost.

Another further object of the present invention is to provide an automatic car toll computing and charging method which can be carried out just through a commercialized cellular phone in market.

For achieve the automatic car toll computing and charging method described above, the main concept of the present invention is that each cellular base station has a limited communication coverage in the cellular phone system. And, because each cellular phone owns a cell ID, when an on-vehicle cellular communication equipment under using passes through one communication coverage and enters another communication coverage, the cell ID will be handed over to another cellular base station. Therefore, the toll of the car can be charged through recording all cell IDs which the on-vehicle cellular communication equipment under using passes therethrouh. However, for avoiding any cellular phone which is under using from being recognized to be charged and to pay the toll, the user has to call a specific number representing a log in of an automatic computing and charging through the on-vehicle cellular communication equipment previously. Furthermore, for differentiating the car which does log in and which does not log in, a connection between a cellular phone number and a vehicle identification number has to be stored previously in a billing center, or the user has to key in the vehicle identification number or other car IDs sufficient to bring out the vehicle identification number. And then, the user can hang up the communication equipment. After the on-vehicle cellular communication equipment which has been logged in leaves the toll road, the user again has to call a specific number representing a log out of the automatic computing and charging through the on-vehicle cellular communication equipment. All the cell IDs of the cellular base stations passed therethrough by the car during the log in and log out are calculated for charging the toll. Moreover, the toll road or bridge further comprises an inspection location which sets one or more automatic photographing devices for recognizing a license plate, and when the car which does not process the log in of the automatic computing and charging through the on-vehicle cellular communication equipment, does not previously store the connection between the cellular phone number and the vehicle identification number in the billing center, or does not key in the vehicle identification number or other car IDs sufficient to bring out the vehicle identification number passes through the inspection location, it will be recognized by the automatic photographing device, and an image and the vehicle identification number of the car will be an evidence for processing a toll supplying.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
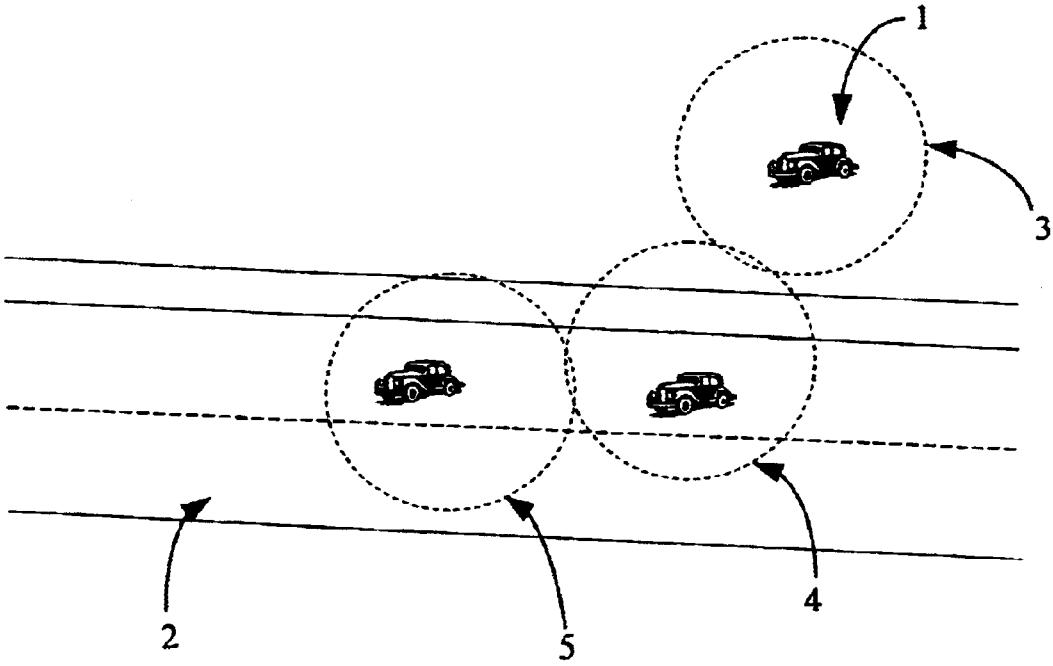
FIG. 1 shows a state diagram of an automatic car toll computing and charging method according to the present invention.
Figure 2:
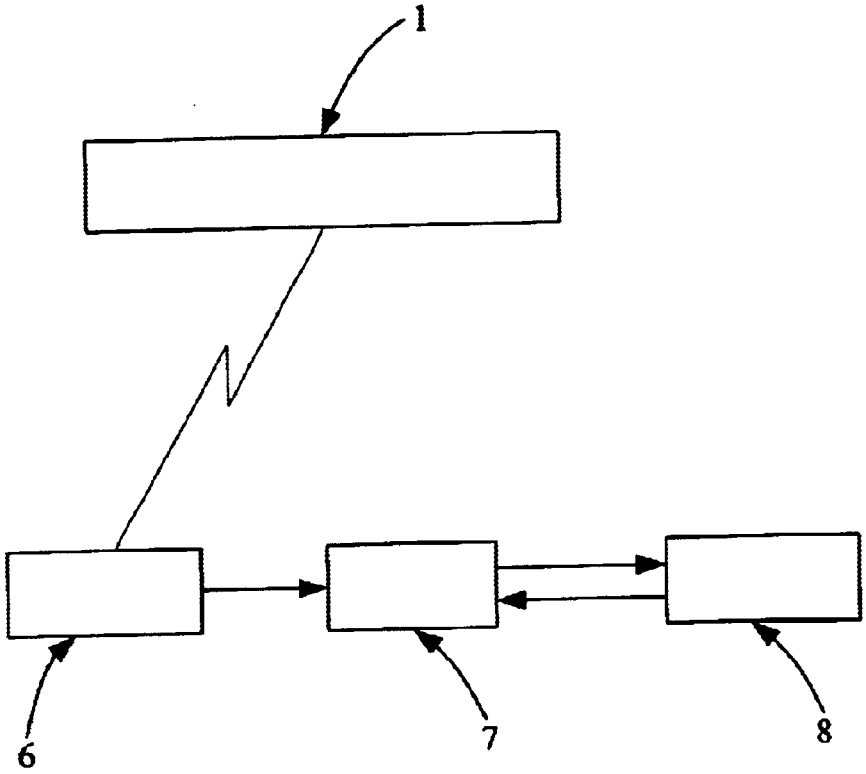
FIG. 2 shows a practicing schematic view of an automatic car toll computing and charging method according to the present invention.

Please refer to FIG. 1 which illustrates a state diagram of an automatic car toll computing and charging method according to the present invention. The main concept of the present invention is that each cellular base station has a limited communication coverage in the cellular phone system. And, because each cellular phone owns a cell ID, when an on-vehicle cellular communication equipment 1 under using passes through a communication coverage 3 and enters another communication coverage 4 or 5, the cell ID will be handed over to another cellular base station. Therefore, the toll of the car can be charged through recording all cell IDs which the on-vehicle cellular communication equipment 1 under using passes therethrouh and the toll can be paid by a finance account appointed through the cellular phone number or by withholding the cash in advance. In addition, the on-vehicle cellular communication equipment 1 can be a commercialized cellular phone in market.

Before the car enters a toll road 2 or bridge, the user previously calls a specific number representing a log in of an automatic computing and charging for logging in a connection between a cellular phone number and a vehicle identification number previously stored in a billing center 7, or keying in the vehicle identification number or other car IDs sufficient to bring out the vehicle identification number through the on-vehicle cellular communication equipment 1 and then hangs up. Then, when under communicating, the cellular base station 6 which covering the on-vehicle cellular communication equipment 1 will transmit the cellular phone number, the vehicle identification number or the car ID sufficient to bring out the identification number to the billing center 7. All the cellular base stations 6 passed therethrough by the on-vehicle cellular communication equipment 1 will also transmit the cellular phone number and the cell ID to the billing center 7. After the car leaves the toll road, the user again calls a specific number representing a log out of an automatic computing and charging through the on-vehicle cellular communication equipment 1 and then hangs up. When under communicating, the cellular base station 6 which covering the on-vehicle cellular communication equipment 1 will transmit a log out message of the cellular phone number to the billing center 7. All the cell IDs of the cellular base stations passed theretrough by the car during the log in and log out are calculated for charging the toll. Moreover, the toll road or bridge further comprises an inspection location 8 which sets one or more automatic photographing devices for recognizing a license plate, and the billing center 7 will transmit the vehicle identification number of the logged in car to the inspection location 8. And, when the car which does not process the log in of the automatic computing and charging through the on-vehicle cellular communication equipment, does not previously store the connection between the cellular phone number and the vehicle identification number in the billing center, or does not key in the vehicle identification number or other car IDs sufficient to bring out the vehicle identification number passes through the inspection location, it will be recognized by the automatic photographing device. The inspection location 8 will transmit an image and the vehicle identification number of the car to the billing center 7, and the image and the vehicle identification number of the car will be an evidence for processing a toll supplying. Furthermore, for facilitating the user, the on-vehicle cellular communication equipment can employs a hot key to call the specific number representing the log in or log out for the automatic computing and charging.

Consequently, the automatic car toll computing and charging method according to the present invention, when being compared with references 1 & 2 and the other prior arts, further includes the advantage as follows:

1. The present invention provides an automatic car toll computing and charging method which can achieve an automatic computing and charging without employing an on-vehicle positioning device to detect an arrival of a toll location so as to economize the cost.
2. The present invention can employ a commercialized cellular phone in market which is now a stable product with a high selectivity to carry out the automatic car toll computing and charging method and the cellular phone.
3. The present invention records all cell IDs passed therethrough by the cellular phone system, and thus it can be applied in the charging methods depend on toll stations, as shown in reference 1, ring roads and mileages. Thus, the present invention, when being compared with reference 1, can be applied in more different charging methods.
4. Reference 1 adopts PID and MID as a connection between the law executing and chargeback, and the present invention adopts the vehicle identification number as a connection between the law executing and chargback. Consequently, the present invention can more precisely recognize the car which has already paid and which has not and take the image evidence as a basis for dunning the toll of the car without payment.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automatic car toll computing and charging method, comprising steps of:

previously storing the connection between a cellular phone number and a vehicle identification number, or keying in said vehicle identification number or other car IDs sufficient to bring out said vehicle identification number in a billing center; and calling a specific number representing a log in of an automatic computing and charging through an on-vehicle cellular communication equipment and before a car enters a toll road or bridge and hanging up; and calling a specific number representing a log out of said automatic computing and charging after leaving said toll road or bridge, so that said toll is charged through calculating all cell IDs which the on-vehicle cellular communication equipment passes therethrough during said log in and said log out.

2. The automatic car toll computing and charging method according to claim 1, wherein said toll road or bridge further comprises one or more inspection location having an automatic photographing device for recognizing a license plate, so that said car, which does not process said log in of said automatic computing and charging through said on-vehicle cellular communication equipment, or does not previously store said connection between said cellular phone number and said vehicle identification number in said billing center, or does not key in said vehicle identification number or other car IDs sufficient to bring out said vehicle identification number in said billing center, is recognized by said automatic photographing device when passing through said inspection location, and an image and said vehicle identification number of said car will be an evidence for processing a toll supplying.

3. The automatic car toll computing and charging method according to claim 1, wherein parts of said cells are microcells which have a relatively smaller communication coverage.

4. The automatic car toll computing and charging method according to claim 1, wherein said toll is paid by a finance account appointed through said cellular phone number.

5. The automatic car toll computing and charging method according to claim 1, wherein said toll is paid through withholding the cash in advance.

6. The automatic car toll computing and charging method according to claim 1, wherein said on-vehicle cellular communication equipment is a normal commercialized cellular phone in the market.

7. The automatic car toll computing and charging method according to claim 1, wherein said on-vehicle cellular communication equipment employs a hot key to call said specific number representing said log in or said log out of said automatic computing and charging conveniently.

* * * * *